United States Patent [19]

Takenoya et al.

[11] Patent Number: 4,527,495

[45] Date of Patent: Jul. 9, 1985

[54] BUTTONHOLE STITCHING PROCESS

[75] Inventors: Hideaki Takenoya; Eiichi Shomura, both of Hachioji, Japan

[73] Assignee: Janome Sewing Machine Industry Co., Inc., Japan

[21] Appl. No.: 601,202

[22] Filed: Apr. 17, 1984

[30] Foreign Application Priority Data

Apr. 18, 1983 [JP] Japan ..... 58-67067

[51] Int. Cl.[3] ..... D05B 3/06; A41F 1/02

[52] U.S. Cl. ..... 112/264.1; 112/446

[58] Field of Search ..... 112/264.1, 158 B

[56] References Cited

U.S. PATENT DOCUMENTS 3,570,433 3/1971 Weisz ..... 112/264.1

4,159,688 7/1979 Garron et al. ..... 112/264.1

4,181,087 1/1980 Brauch et al. ..... 112/264.1

4,215,640 8/1980 Coughenour ..... 112/264.1

4,465,004 8/1984 Wurst ..... 112/264.1

*Primary Examiner*—Werner H. Schroeder

*Assistant Examiner*—Andrew M. Falik

*Attorney, Agent, or Firm*—William A. Drucker

[57] ABSTRACT

A process for stitching a buttonhole in the forward and reverse fabric feeding directions by means of a zigzag sewing machine including the step of producing one or more of stitches at a critical pattern changing point which will serve as a reference mark for enabling the sewing machine operator to operate the sewing machine as required with ease for the pattern changing operation.

3 Claims, 11 Drawing Figures

BUTTONHOLE STITCHING PROCESS

BACKGROUND OF THE INVENTION

The inventin relates to a process for stitching a buttonhole, and more particularly to a process for stitching, by means of a zigzag sewing machine, a buttonhole of pigeon-eye type comprising a pattern A of first bar-tack stitches, a pattern B of first line-tack stitches, a pattern C of stitches surrounding the pigeon-eye buttonhole, a pattern Ba of second line-tack stitches and a pattern Aa of second bar-tack stitches as shown in FIG. 1, produced in the order named.

FIGS. 2A through 2C show the order in which this type of buttonhole stitches is produced with the zigzag sewing machine. If the sewing machine operator operates a pattern selecting switch designating the combination of patterns A and B and then drive the sewing machine, the pattern A of a predetermined number of stitches 1–10 and the pattern B of repeated stitches 11-10-11-10 are at first continuously produced in the forward feeding direction. The number of stitches in the pattern B may be optionally determined from the point P in dependence upon the size of buttonhole that the operator desires.

When the pattern B is continuously stitched in a length desired by the operator to reach the point Q, the operator stops the sewing machine and is required to operate another pattern selecting switch designating the combination of patterns C and Ba and then drives again the sewing machine, the pattern C is produced with the predetermined number of stitches 1–30 from the point Q to the point R and then the pattern Ba is continuously produced in the reverse feeding direction with the stitches 31-32-31-32 which are counterparts of the stitches 10-11-10-11 of the pattern B. The operator is, however, required to stop the sewing machine when the last stitch of the pattern Ba has come into alignment at the point S with the initial stitch 9-10 at the point P of the pattern B, so that the patterns may be a complete symmetry on both sides of the vertical center line of the buttonhole, as shown in FIG. 1. And then, the operator is required to operate another pattern selecting switch designating the last pattern Aa with the predetermined number of stitches 1–10, which are counterparts of the stitches 1–10 of the pattern A, and then to drive the sewing machine until the sewing machine is automatically stopped. Thus the buttonhole of pigeon-type is completely stitched.

However, it is to be noted that there is difficulty in placing the last stitch of the pattern Ba into alignment at the point S with the initial stitch 9-10 of the pattern B at the point P as shown in FIGS. 1 and 2, and the machine operator have often failed to do this task, resulting in the deformation of the buttonhole stitches such as shown in FIGS. 3A, 3B and 3C. FIG. 3A shows an example wherein the operator has switched the pattern Ba over to the pattern Aa before the pattern Ba comes to the point P of the pattern B. FIGS. 3B and 3C show examples wherein the operator has switched the pattern Ba over to the pattern Aa after the pattern Ba went past the point P of the pattern B.

SUMMARY OF THE INVENTION

The process in accordance with the invention has been provided to eliminate the deficiencies and inconvenience of the prior art which may have often caused the sewing machine operator to make errors in stitching the buttonhole of such a type as mentioned.

According to the invention there is provided a process for stitching a buttonhole of a type consisting of at least three different patterns of stitches which are sequentially formed in the forward and reverse directions by means of a zigzag sewing machine, two of the patterns being formed with a predetermined number of stitches respectively and the other one being formed with an optional number of stitches, comprising the steps of continuously producing in one of the feeding directions a first half of a first pattern of a predetermined number of stitches and a first half of a second pattern which may be of an optional number of stitches; continuously producing in said one and the opposite feeding directions a third pattern of a predetermined number of stitches and a second half of the second pattern until the second half of the second pattern comes to the stitch at the junction between the first and second patterns; and producing a second half of the first pattern in the opposite direction, wherein the last one stitch of the first half of the first pattern is extended transversely of the feeding direction to a point which is located adjacent to the junction between the second halves of the second and first patterns.

BRIEF DESCRIPTION OF THE DRAWINGS

The other objects and advantages of the invention can be fully understood from the following detailed description when read in conjunction with the accompanying drawings in which.

PREFERRRED EMBODIMENTS OF THE INVENTION

The process for stitching the buttonhole of this type has been described hereinbefore in reference to FIGS. 1 and 2A–2C. Therefore, explanation will be given only to the essential point of the invention in reference to FIGS. 4A through 4D.

Figure 3A:
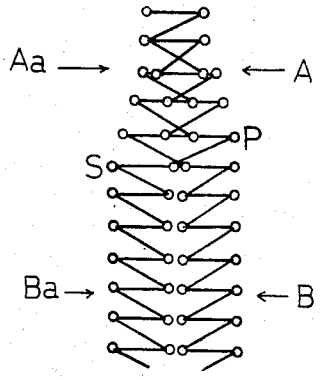
FIG. 3A PRIOR ART
FIGS. 3A through 3C are diagrammatic views showing deformed samples of the buttonhole stitches which may have been produced in the prior art manner.
Figure 3B:
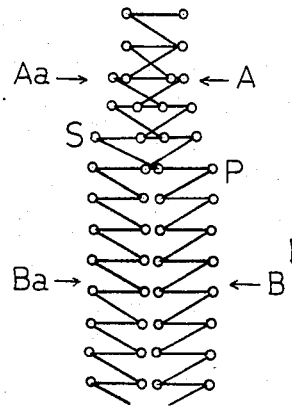
FIG. 3B PRIOR ART
Figure 3C:
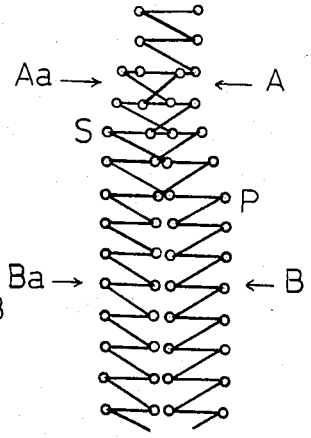
FIG. 3C PRIOR ART
Figure 4A:
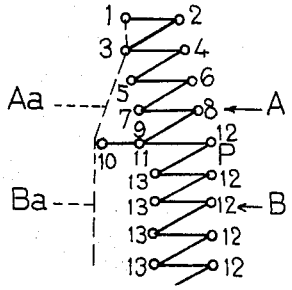
FIGS. 4A through 4D are diagrammatic views showing a buttonhole produced in accordance with the process of the invention.

In FIG. 4A, the pattern A is produced in the forward feeding direction from the stitch 1. When the pattern A comes to the last stitch 9, a stitch 9-10 is continuously produced with a predetermined width in the lefthand direction transversely of the feeding direction, and then the transversing stitches 10-11 and 11-12 are produced in alignment with each other at the point P, the stitch 11-12 defining a junction between the pattern A and the subsequent pattern B. The transverse stitch 9-10 has been provided to serve as a mark for indicating the sewing machine operator to stop the sewing mchine and operate the pattern selecting switch designating the pattern Aa, when the last stitch of the pattern Ba has come to the transverse stitch 9-10 in the reverse feeding direction, so that the operator may avoid to make errors and deficiencies of the buttonhole as shown in FIGS. 3A–3C.

Figure 4B:
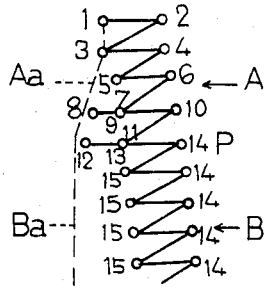

In FIG. 4B there are provided two marking stitches 7-8 and 11-12 in the same manner as in FIG. 4A, so as to make the machine stopping point S more apparent to the operator.

Figure 1:
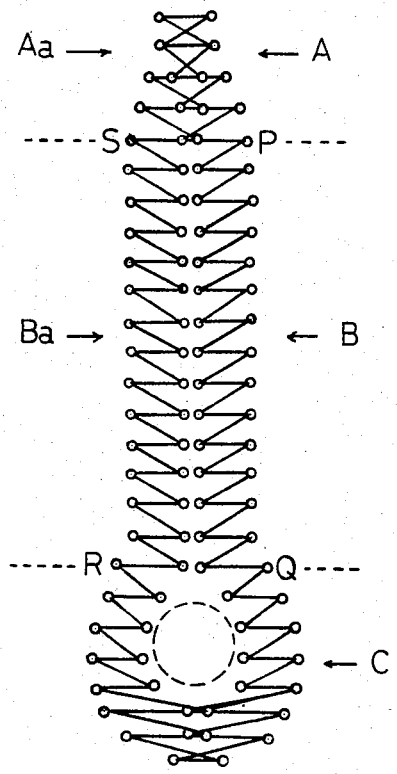
FIG. 1 is a diagrammatic view showing a stitch for buttonhole of a type concerned to the invention.
Figure 2A:
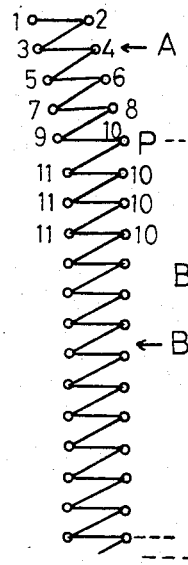
FIGS. 2A through 2C are diagrammatic views showing the order of formation of the stitch shown in FIG. 1.
Figure 2B:
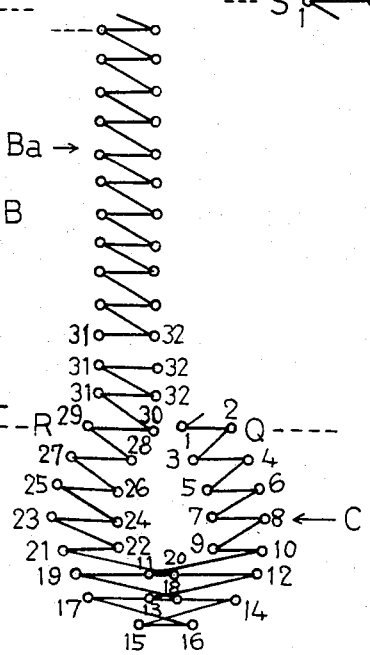
Figure 2C:
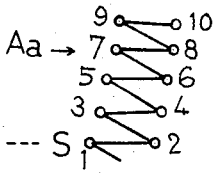
Figure 4C:
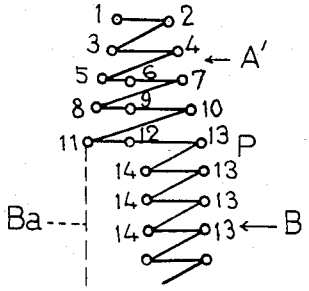
Figure 4D:
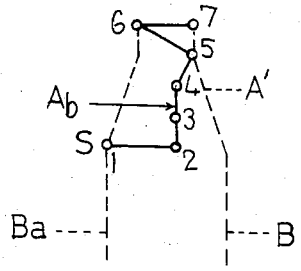

In FIGS. 4C and 4D, instead of the patterns A and Aa, a different pattern A′ of stitches 1–13 is at first produced in the forward feeding direction, which is simplified but is substantially the same with the combination of the patterns A and Aa in FIGS. 2A and 2C. In this embodiment, the stitches 5-6, 8-9 and 11-12 can be regarded as the reference marks like the stitch 9-10 in FIG. 4A and the stitches 7-8 and 11-12 in FIG. 4B. Therefore, when the pattern Ba is produced in the reverse feeding direction until the last stitch comes to the point S in FIG. 4D which is located on the lateral extension of stitches 11-12-13 at the point P in FIG. 4C, the sewing machine operator may stop the sewing machine and operate the pattern selecting switch designating the pattern Ab of stitches 1–7. In fact, the buttonhole stitch is finished when the last stitch of pattern Ba has come to the point S, but the pattern Ab of stitches 1–7 has been provided to repeatedly produce the same buttonhole from the initial stitch 1.

While the invention has been described in conjunction with specific embodiments thereof, it is to be understood that many different modifications and variations may be made without departing from the spirit and scope thereof.

What is claimed is:

1. Process for stitching a buttonhole of a type consisting of at least three different patterns of stitches which are sequentially formed in the forward and reverse directions by means of a zigzag sewing machine, two of said patterns being formed with a predetermined number of stitches respectively and the other one being formed with an optional number of stitches, comprising the steps of continuously producing in one of said feeding directions a first half of a first pattern of a predetermined number of stitches and a first half of a second pattern which may be of an optional number of stitches; continuously producing in said one and the opposite directions a third pattern of a predetermined number of stitches and a second half of said second pattern until said second half of said second pattern comes to the stiches at the junction between the first halves of said first and second patterns; and producing a second half of said first pattern in the opposite direction; wherein the last one stitch of said first half of said first pattern is extended transversely of the feeding direction to a point which is located adjacent to the junction between said second halves of said second and first patterns.

2. Process as claimed in claim 1 wherein an additional stitch is produced in said first half of said first pattern, in alignment with and in the opposite direction from the last stitch of said first half of said first pattern.

3. Process as claimed in claim 1 wherein said first half of said first pattern is stitched substantially symmetrically in a width of the entire first pattern.

* * * * *